US010080695B1

(12) United States Patent
Lin

(10) Patent No.: US 10,080,695 B1
(45) Date of Patent: Sep. 25, 2018

(54) WHEELCHAIR

(71) Applicant: Green Young Industrial Co., Ltd., Tainan (TW)

(72) Inventor: Fang-Sheng Lin, Tainan City (TW)

(73) Assignee: Green Young Industrial Co., Ltd., Tainan (TW)

( * ) Notice: Subject to any disclaimer, the term of this patent is extended or adjusted under 35 U.S.C. 154(b) by 0 days.

(21) Appl. No.: 15/884,448

(22) Filed: Jan. 31, 2018

(51) Int. Cl.
*A61G 5/10* (2006.01)
*A61G 5/12* (2006.01)

(52) U.S. Cl.
CPC ..... *A61G 5/1062* (2013.01); *A61G 5/1067* (2013.01); *A61G 5/1002* (2013.01); *A61G 5/128* (2016.11)

(58) Field of Classification Search
CPC .... A61G 5/1056–5/1062; A61G 5/128; A61G 5/1002
See application file for complete search history.

(56) References Cited

U.S. PATENT DOCUMENTS 5,564,786 A * 10/1996 Peek ..... A61G 5/10 280/250.1
6,296,265 B1 * 10/2001 Lovins ..... A61G 5/12 280/250.1
6,352,307 B1 * 3/2002 Engman ..... A61G 5/1059 297/284.1
9,474,665 B1 * 10/2016 Chan ..... A61G 5/047
2004/0188979 A1 * 9/2004 Bernatsky ..... A61G 5/12 280/304.1
2007/0145723 A1 * 6/2007 Kamara ..... A61G 5/08 280/647
2009/0045599 A1 * 2/2009 Balcom ..... A61G 5/1075 280/250.1
2010/0194071 A1 * 8/2010 Knopf ..... A61G 5/1059 280/250.1
2013/0091626 A1 * 4/2013 Al-Jafar ..... E03D 5/00 4/321
2013/0214509 A1 * 8/2013 Melgarejo ..... A61G 5/12 280/304.1
2014/0252747 A1 * 9/2014 Hermes ..... A61G 5/1062 280/291
2014/0306495 A1 * 10/2014 Griggs ..... A61G 5/1002 297/188.08

(Continued)

*Primary Examiner* — Erez Gurari
(74) *Attorney, Agent, or Firm* — Alan D. Kamrath; Kamrath IP Lawfirm, P.A.

(57) ABSTRACT

A wheelchair is disclosed. Two ends of each of the seat connection tubes are connected with the seat frame and the corresponding side frame, respectively. The seat frame and the seat connection tubes are telescopic by the combination of pressing units and holes. Two ends of each of the front connection tubes are connected with the front tube and the corresponding side frame, respectively. The front tube and the front connection tubes are telescopic by the combination of pressing units and holes. Two ends of each of the rear connection tubes are connected with the rear tube and the corresponding side frame. The rear tube and the rear connection tubes are telescopic by the combination of pressing units and holes. Each back connection tube is connected with the back unit and the corresponding supporting frame. The back unit and the back connection tubes are telescopic by the screwing elements.

10 Claims, 9 Drawing Sheets

(56) References Cited

U.S. PATENT DOCUMENTS

| | | | | |
|---|---|---|---|---|
| 2014/0327231 | A1* | 11/2014 | Perk | A61G 5/02<br>280/647 |
| 2015/0164717 | A1* | 6/2015 | Lee | A61G 5/04<br>701/22 |
| 2017/0273840 | A1* | 9/2017 | Melgarejo | A61G 5/1075 |

* cited by examiner

WHEELCHAIR

BACKGROUND OF THE INVENTION

1. Field of the Invention

This invention relates to a wheelchair and, in particular, to a wheelchair having an adjustable width and a back unit which can be disposed in the middle.

2. Description of the Related Art

A wheelchair is an indispensable tool for the injured people, and its functionality is also improved continually to make the user feel more comfortable. Some places, such as the hospital and rehabilitation center, need to be equipped with many wheelchairs for the usage of users. However, since everybody is different in the physical size, the wheelchairs need to be purchased according to the different physical sizes. But, this will result in some disadvantages. One of the disadvantages is that the cost will be increased. Moreover, the wheelchairs in the market just have some standard sizes, so the user with the physical size between the two standards cannot be given a comfortable feeling in the usage.

Therefore, it is an important subject to provide a wheelchair whose width can be adjusted according to the physical size of the user, so that the all users can obtain a comfortable feeling in the usage.

BRIEF SUMMARY OF THE INVENTION

In view of the foregoing subject, an objective of the present invention is to provide a wheelchair whose width can be adjusted according to the physical size of the user, so that the all users can obtain a comfortable feeling in the usage.

A wheelchair of the present invention includes two side frames, two wheels, a telescopic seat frame set, a telescopic front enhancement tube set, a telescopic rear enhancement tube set, two supporting units, and a telescopic back set. The two wheels are connected with the two side frames respectively. The telescopic seat frame set includes a seat frame and a plurality of seat connection tubes, wherein two ends of each of the seat connection tubes are connected with the seat frame and a corresponding one of the side frames, respectively, and the seat frame and the seat connection tubes are made telescopic by a combination of pressing units and holes. The telescopic front enhancement tube set includes a front tube and a plurality of front connection tubes, wherein two ends of each of the front connection tubes are connected with the front tube and a corresponding one of the side frames, respectively, and the front tube and the front connection tubes are made telescopic by a combination of pressing units and holes. The telescopic rear enhancement tube set includes a rear tube and a plurality of rear connection tubes, wherein two ends of each of the rear connection tubes are connected with the rear tube and a corresponding one of the side frames, respectively, and the rear tube and the rear connection tubes are made telescopic by a combination of pressing units and holes. The two supporting units are connected with the two side frames respectively. The telescopic back set includes a back unit and a plurality of back connection tubes, wherein each of the back connection tubes are connected with the back unit and a corresponding one of the supporting units, respectively, and the back unit and the back connection tubes are made telescopic by a plurality of screwing elements.

In one embodiment, each seat connection tube includes a bent portion and is connected with the corresponding side frame through the bent portion.

In one embodiment, one end of each of the seat connection tubes connected with the side frame is connected with the side frame by a pressing unit.

In one embodiment, each of the front connection tubes includes a bent portion and is connected with the corresponding side frame through the bent portion.

In one embodiment, one end of each of the front connection tubes connected with the side frame is connected with the side frame by a pressing unit.

In one embodiment, the supporting units are connected with a holding tube to form a holding bar of the wheelchair, and the holding tube and the supporting units are made telescopic by a combination of a plurality of pressing units and a plurality of holes.

In one embodiment, the back unit and the back connection tubes are made telescopic by a combination of the screwing elements and a plurality of marks, the marks are disposed on the back connection tubes and the screwing elements are disposed on the back unit.

In one embodiment, the back unit and the back connection tubes are made telescopic by a combination of the screwing elements and a plurality of marks, and a distance between the two adjacent holes is substantially equal to a distance between the two adjacent marks.

In one embodiment, the wheelchair further includes a seat disposed on the seat frame.

In one embodiment, the pressing unit includes a pressing button and a spring element connected with the pressing button.

As mentioned above, a wheelchair according to the invention includes the telescopic seat frame set, the telescopic front enhancement tube set, the telescopic rear enhancement tube set, and the telescopic back set. By the above configuration, the wheelchair of the invention can be easily adjusted in width according to the physical size of the user so that the all users can be given the fine comfort. Besides, the back unit and the back connection tubes can be given the telescopic function by a plurality of screwing elements. Thereby, when the wheelchair is adjusted in width, the back unit also can be adjusted to the middle position to hold the user's head or back.

The present invention will become clearer in light of the following detailed description of illustrative embodiments of this invention described in connection with the drawings, wherein the same references relate to the same elements.

DESCRIPTION OF THE DRAWINGS

The illustrative embodiments of this invention may best be described by reference to the accompanying drawings where.

DETAILED DESCRIPTION OF THE INVENTION

Figure 1:
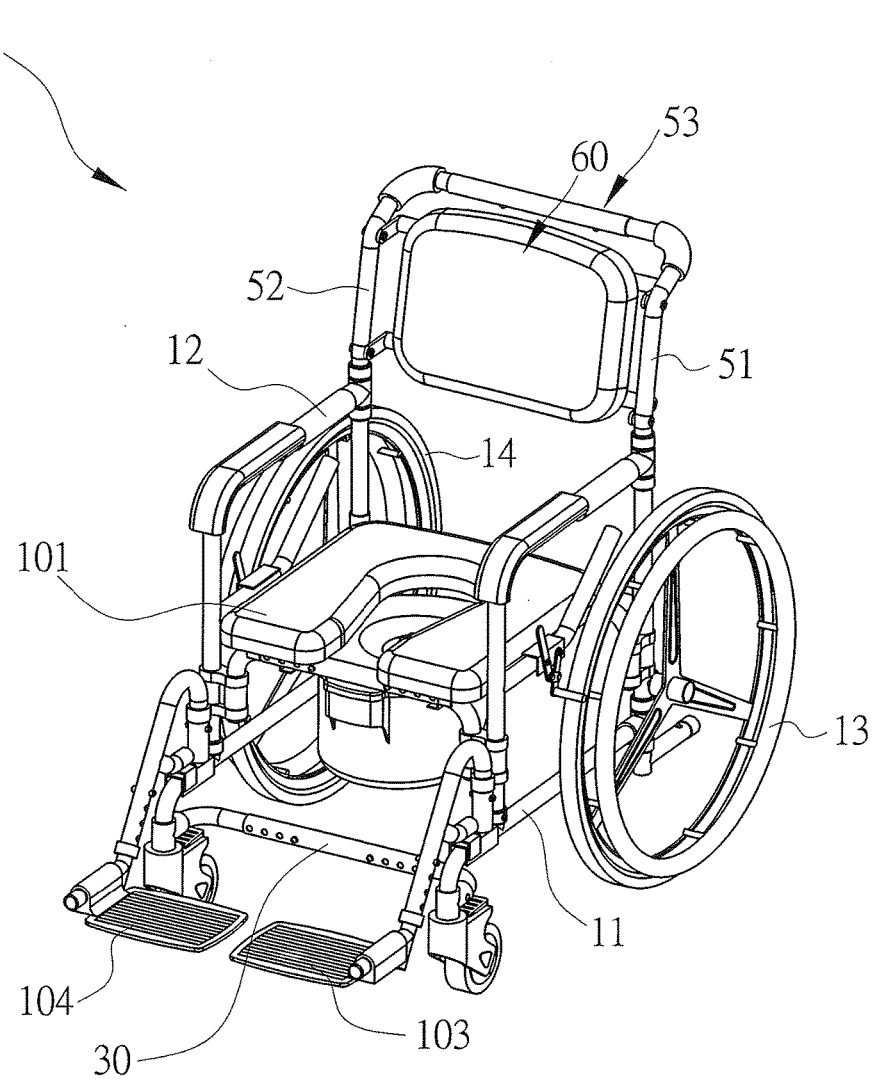
FIG. 1 is a schematic diagram of a wheelchair of an embodiment of the invention.
Figure 2:
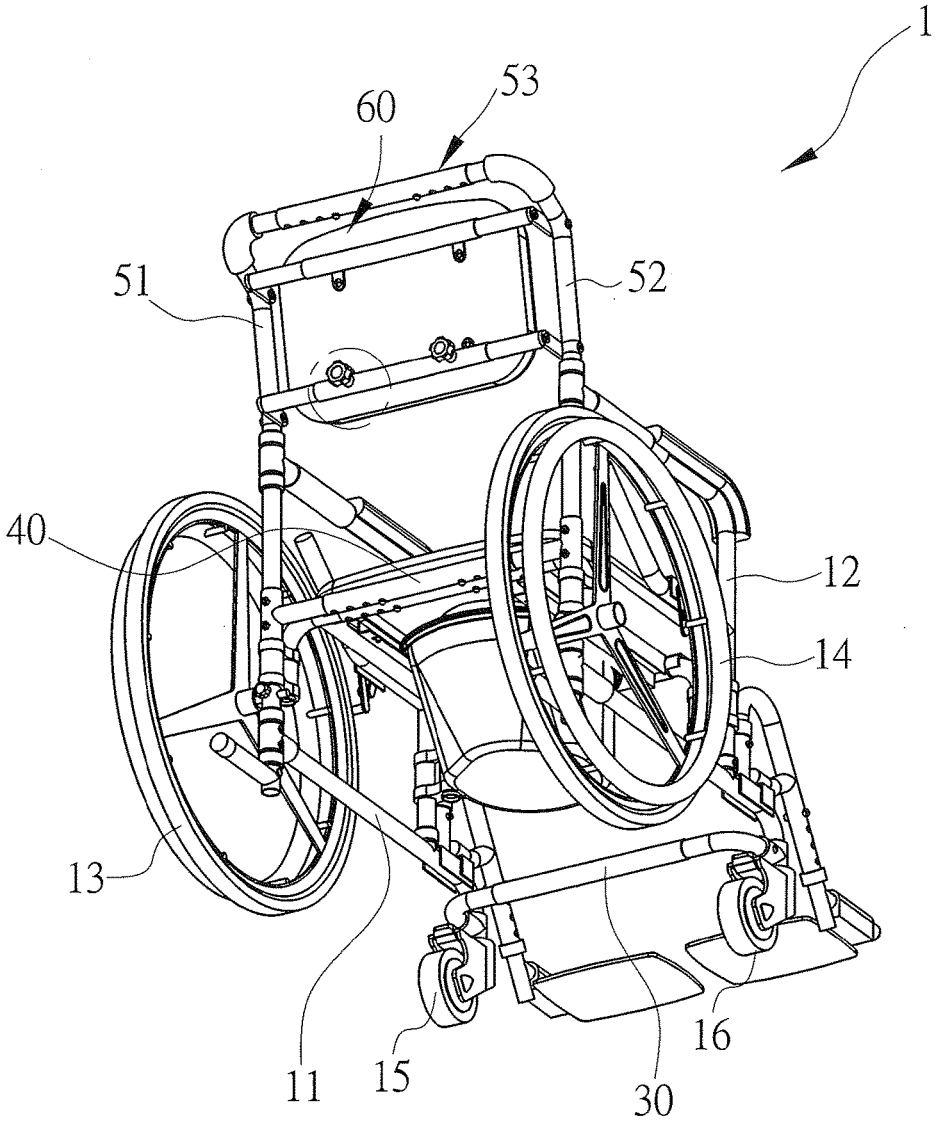
FIG. 2 is a schematic diagram of the wheelchair of an embodiment of the invention in another viewing angle.
Figure 3:
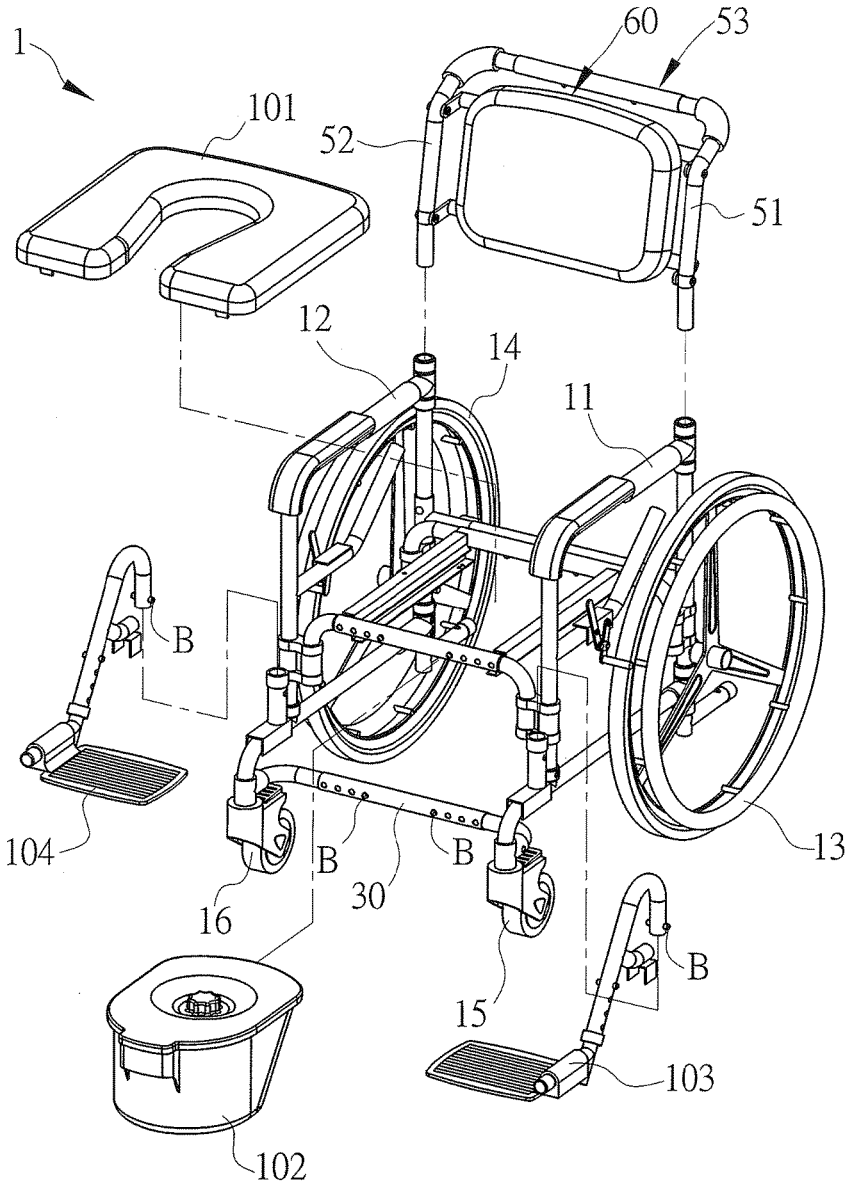
FIG. 3 is an exploded diagram of a wheelchair of an embodiment of the invention.
Figure 4:
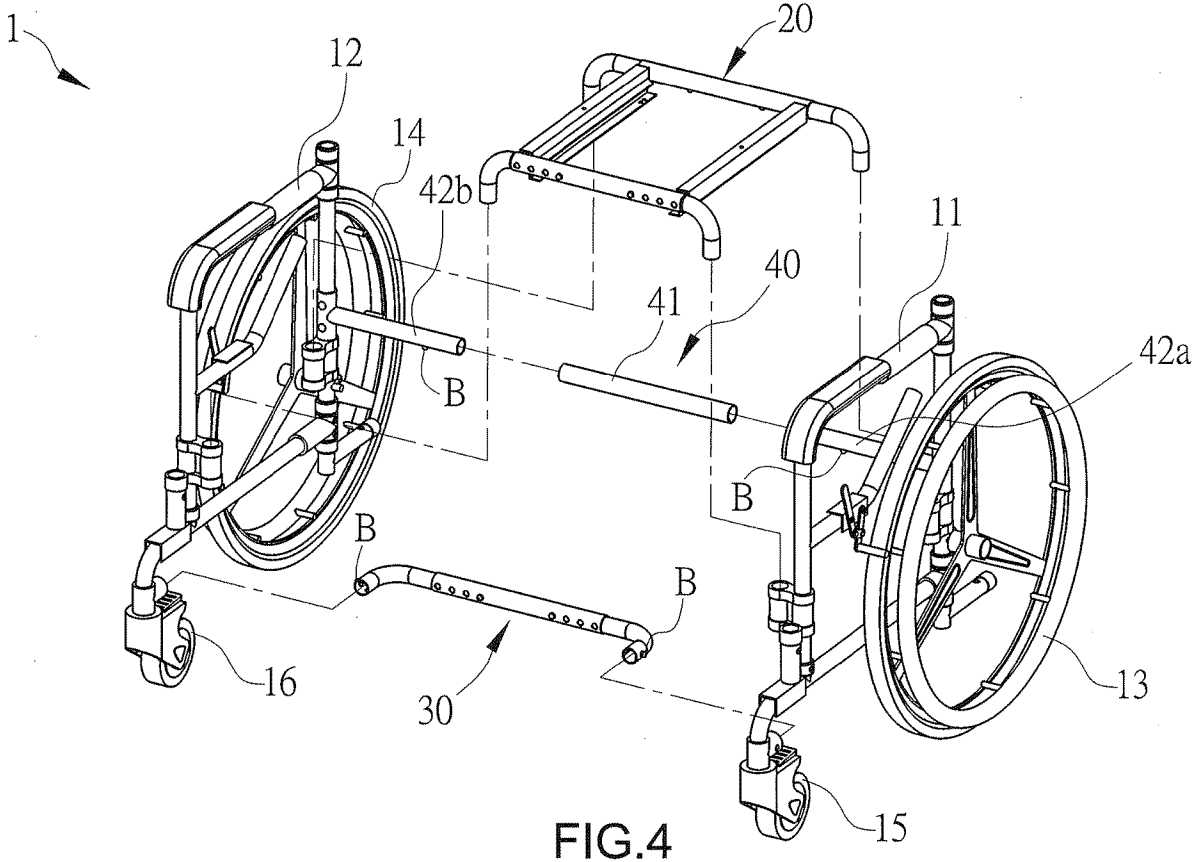
FIG. 4 is another exploded diagram of the wheelchair of an embodiment of the invention.

FIG. 1 is a schematic diagram of a wheelchair 1 of an embodiment of the invention. FIG. 2 is a schematic diagram of the wheelchair 1 in another viewing angle. FIG. 3 is an exploded diagram of the wheelchair 1. FIG. 4 is another exploded diagram of the wheelchair 1, wherein some components are omitted for more clearly showing the particular components. Please refer to FIGS. 1 to 4 to illustrate the wheelchair 1 of this embodiment.

The wheelchair 1 of this embodiment includes two side frames 11 and 12, two wheels 13 and 14, a telescopic seat frame set 20, a telescopic front enhancement tube set 30, a telescopic rear enhancement tube set 40, two supporting units 51 and 52, and a telescopic back set 60.

In this embodiment, the two side frames 11 and 12 are used as the left and right supporting frames of the wheelchair 1 and can be connected with several components, such as the telescopic seat frame set 20, the telescopic front enhancement tube set 30, the telescopic rear enhancement tube set 40 and two supporting units 51 and 52. In this embodiment, the side frames 11 and 12 include a plurality of tubes which can be connected with the above-mentioned components. When the above-mentioned components are connected to the side frames 11 and 12, the width of the wheelchair 1 is determined. The two wheels 13 and 14 are used for the wheelchair 1 moving on the ground. Besides, one end of the side frame 11 is configured with a front wheel 15, and one end of the side frame 12 is configured with a front wheel 16. The size of each of the front wheels 15 and 16 is smaller than that of the wheels 13 and 14. The front wheels 15 and 16 can cooperate with the wheels 13 and 14 to make the wheelchair 1 move on the ground.

Figure 5:
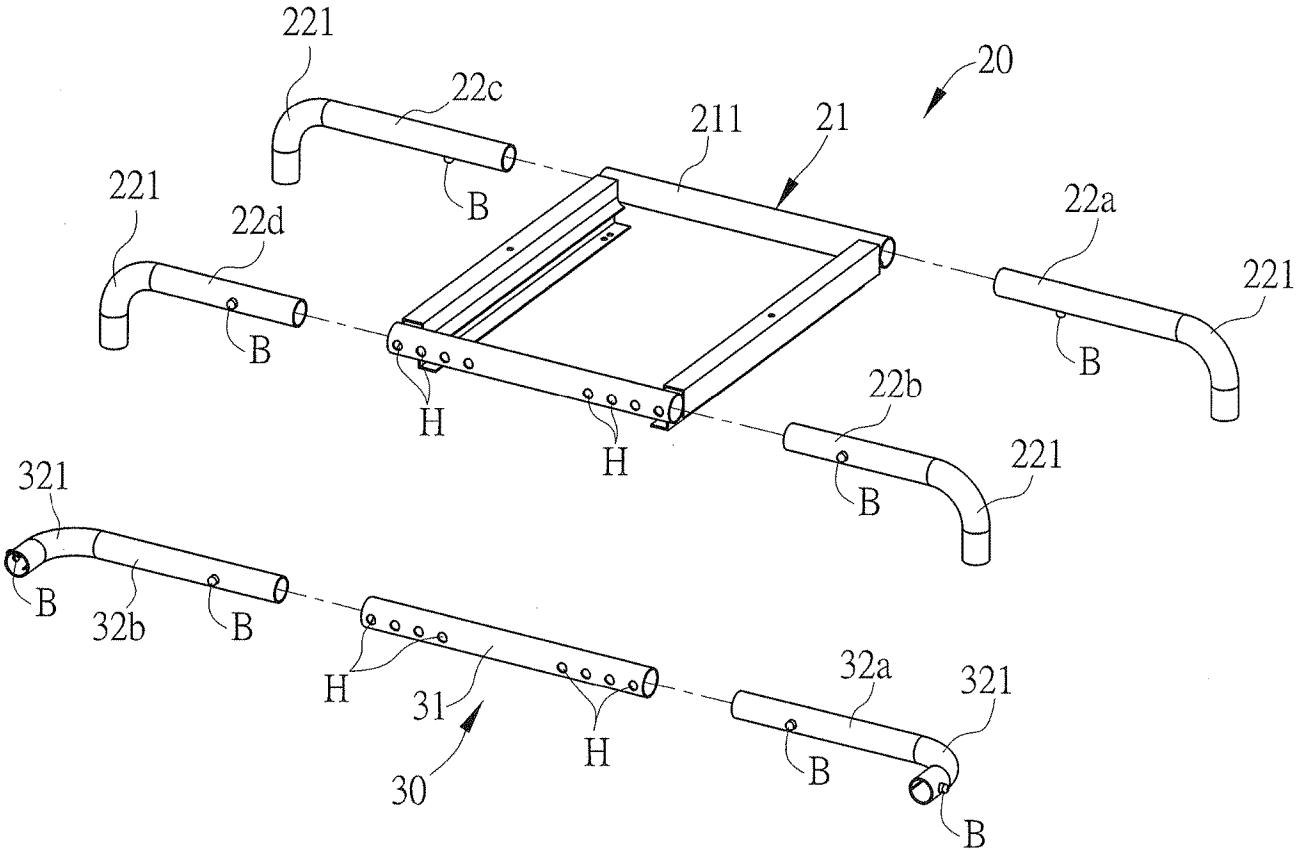
FIG. 5 is an exploded diagram of the telescopic seat frame set and the telescopic front enhancement tube set of an embodiment of the invention.

The telescopic seat frame set 20 is connected with the side frames 11 and 12. FIG. 5 is an exploded diagram of the telescopic seat frame set 20 of an embodiment of the invention. As shown in FIG. 5, herein, the telescopic seat frame set 20 includes a seat frame 21 and a plurality of seat connection tubes 22*a*, 22*b*, 22*c*, 22*d*. The seat frame 21 functions as a main supporting structure. The seat connection tubes 22*a*, 22*b*, 22*c*, 22*d* are connected with the seat frame 21. As shown in FIGS. 1~5, two ends of each of the seat connection tubes 22*a*~22*d* are connected with the seat frame 21 and the corresponding side frame, respectively. Herein for example, the seat connection tubes 22*a* and 22*b* are connected with the seat frame 21 and the side frame 11, and the seat connection tubes 22*c* and 22*d* are connected with the seat frame 21 and the side frame 12. The seat frame 21 and the seat connection tubes 22*a*~22*d* are collectively telescopic by the combination of a plurality of pressing buttons B (the pressing units 105) and a plurality of holes H.

Figure 8:
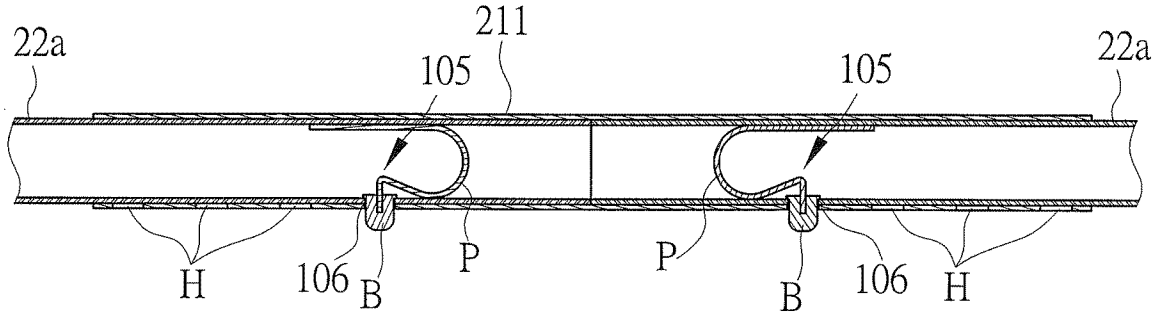
FIGS. 8 and 9 are schematic diagrams of the operation of the pressing units with the holes of an embodiment of the invention.
Figure 9:
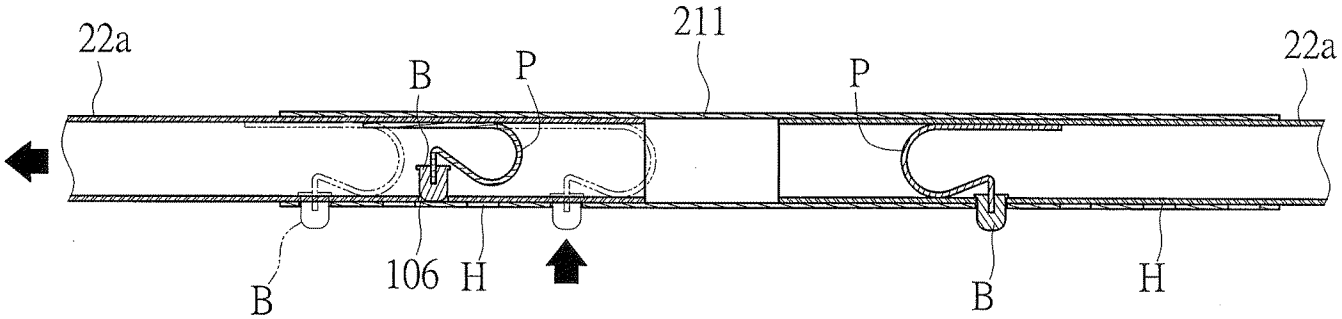

The operation between the pressing button B and the holes H can be shown by referring to FIGS. 8 and 9. As shown in FIGS. 8 and 9, for example, the pressing button B is connected with a spring element P. Herein, the pressing unit 105 includes a pressing button B and a spring element P. The pressing button B protrudes from the tube 22*a* through a through-hole 106, and the pressing button B is connected with the spring element P disposed within the tube 22*a*. When the pressing button B is pressed, the pressing button B will be retracted by the elasticity of the spring element P. Meanwhile, the seat connection tube 22*a* can move within a corresponding tube 211 of the seat frame 21, and will be extended and protruded from the hole H again until moving to the next hole H. If the position needs to be adjusted, the pressing button B can be pressed again to move to the next hole H. Thus, the pressing button B can be positioned. By moving the pressing button B to another hole H, a width of the telescopic seat frame set 20 can be adjusted to adjust the width of the wheelchair 1. Besides, the adjustment can be performed in a single-side manner or a dual-side manner. To be noted, in another embodiment where the seat connection tubes 22*a*~22*d* can be configured with a plurality holes while the seat frame 21 can be configured with a pressing button, the telescopic function also can be achieved, and this disposition also apply to the components described hereinafter.

In this embodiment, each of the seat connection tubes 22*a*~22*d* has a bent portion 221 and connects to the corresponding side frames 11, 12 through the bent portions 221. By the configuration of the bent portion 221, the seat connection tubes 22*a*~22*d* can be connected with the side frames 11, 12 in a manner similar to a downward insertion, which is convenient for the installation and dismantling. Moreover, the end of each of the seat connection tubes 22*a*~22*d* connected with the side frame 11 or 12 is connected to the side frame 11 or 12 through a pressing button B. In other words, one end of each of the seat connection tubes 22*a*~22*d* is connected with a tube of the side frame 11 or 12, and the tube of the side frame 11 or 12 is configured with at least one hole for accommodating the pressing button B. Since the connection manner of the pressing button with the hole has been illustrated above, the related description here is omitted for conciseness.

FIG. 5 is also an exploded diagram of the telescopic front enhancement tube set 30 of an embodiment of the invention. As shown in FIG. 5, in this embodiment, the telescopic front enhancement tube set 30 includes a front tube 31 and a plurality of front connection tubes 32*a* and 32*b*. Two ends of each of the front connection tubes 32*a* and 32*b* are connected with the front tube 31 and the corresponding side frame 11 or 12, respectively. Herein, the two ends of the front connection tube 32*a* are connected with the front tube 31 and the corresponding side frame 11, respectively. Besides, the two ends of the front connection tube 32*b* are connected with the front tube 31 and the corresponding side frame 12, respectively. Furthermore, the front tube 31 and the front connection tubes 32*a* and 32*b* can be collectively telescopic by the combination of a plurality of pressing buttons B and a plurality of holes H. In this embodiment, each of the front connection tubes 32*a* and 32*b* has a bent portion 321 and connects with the corresponding side frame 11 or 12 through the bent portion 321. Besides, the end of each of the front connection tubes 32*a* and 32*b* connected to the side frame 11 or 12 is connected to the side frame 11 or 12 through a pressing button B. Since the connection manner for them is similar to the above embodiments, the related description is omitted here for conciseness.

As shown in FIGS. 2 and 4, in this embodiment, the telescopic rear enhancement tube set 40 includes a rear tube 41 and a plurality of rear connection tubes 42*a* and 42*b*. Two ends of each of the rear connection tubes 42*a* and 42*b* are connected with the rear tube 41 and the corresponding side frame 11 or 12, respectively. Herein, the two ends of the rear connection tube 42*a* are connected with the rear tube 41 and the corresponding side frame 11, respectively. Besides, the two ends of the rear connection tube 42*b* are connected with the rear tube 41 and the corresponding side frame 12, respectively. Furthermore, the rear tube 41 and the rear connection tubes 42*a* and 42*b* can be collectively telescopic by the combination of a plurality of pressing buttons B and a plurality of holes H. Since the connection manner for them is similar to the above embodiments, the related description is omitted here for conciseness.

Figure 6:
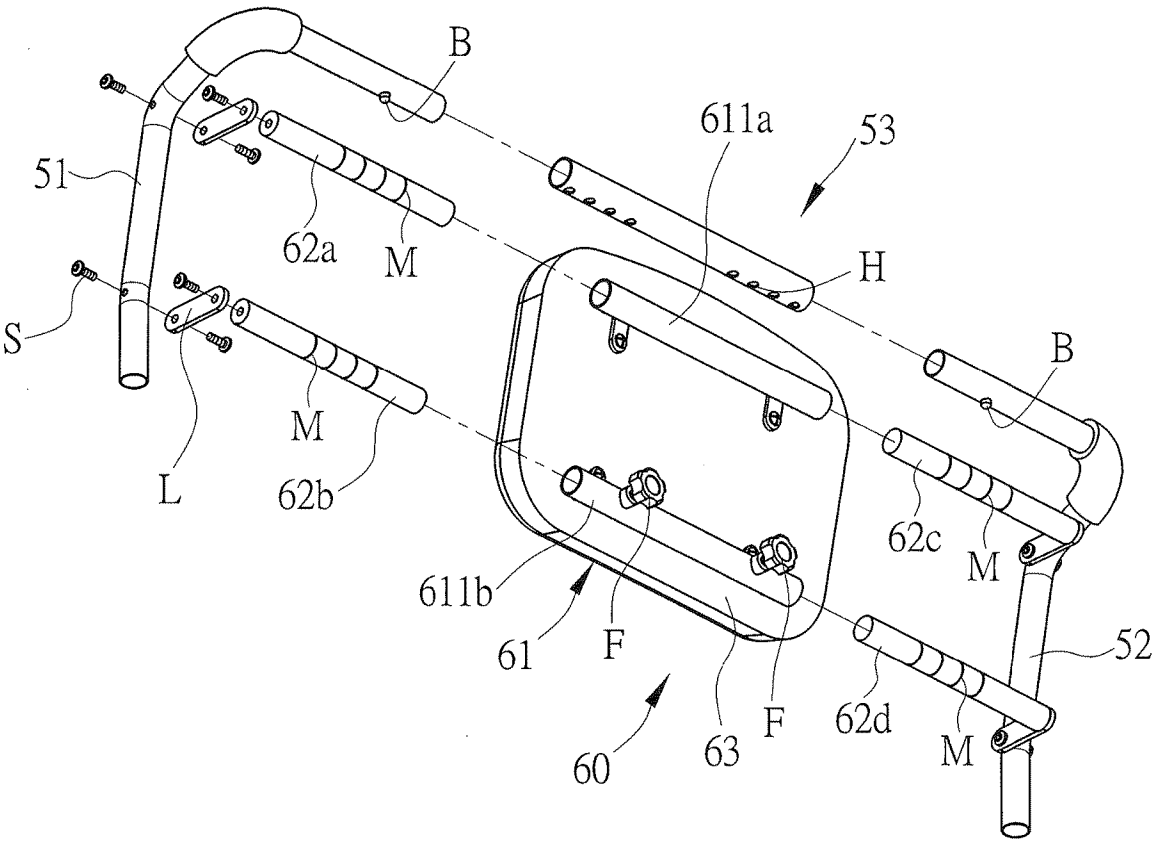
FIG. 6 is an exploded diagram of the two supporting units and the telescopic back set of an embodiment of the invention.

FIG. 6 is an exploded diagram of two supporting units 51 and 52 and the telescopic back set 60 of an embodiment of the invention. Please refer to FIGS. 1, 2, 3, 6 to illustrate the supporting units 51, 52 and the telescopic back set 60 of this embodiment. The two supporting units 51, 52 are connected with the two side frames 11, 12, respectively. Herein for example, the supporting unit 51 is connected with the side frame 11 and the supporting unit 52 is connected with the side frame 12. The supporting units 51, 52 and the side frames 11, 12 can be connected together by, for example, the combination of the buttons and the holes or the screwing method.

In this embodiment, the telescopic back set 60 includes a back unit 61 and a plurality of back connection tubes 62*a*, 62*b*, 62*c*, 62*d*. Each of the back connection tubes 62*a*~62*d* are connected with the back unit 61 and the corresponding supporting units 51, 52. Herein for example, the back connection tubes 62*a* and 62*b* are connected with the back unit 61 and the supporting unit 51, and the back connection tubes 62*c* and 62*d* are connected with the back unit 61 and the supporting unit 52. In this embodiment, the back connection tubes 62*a*~62*d* are connected with the supporting unit 51, 52 by the screws S and the locking sheets L.

Figure 10:
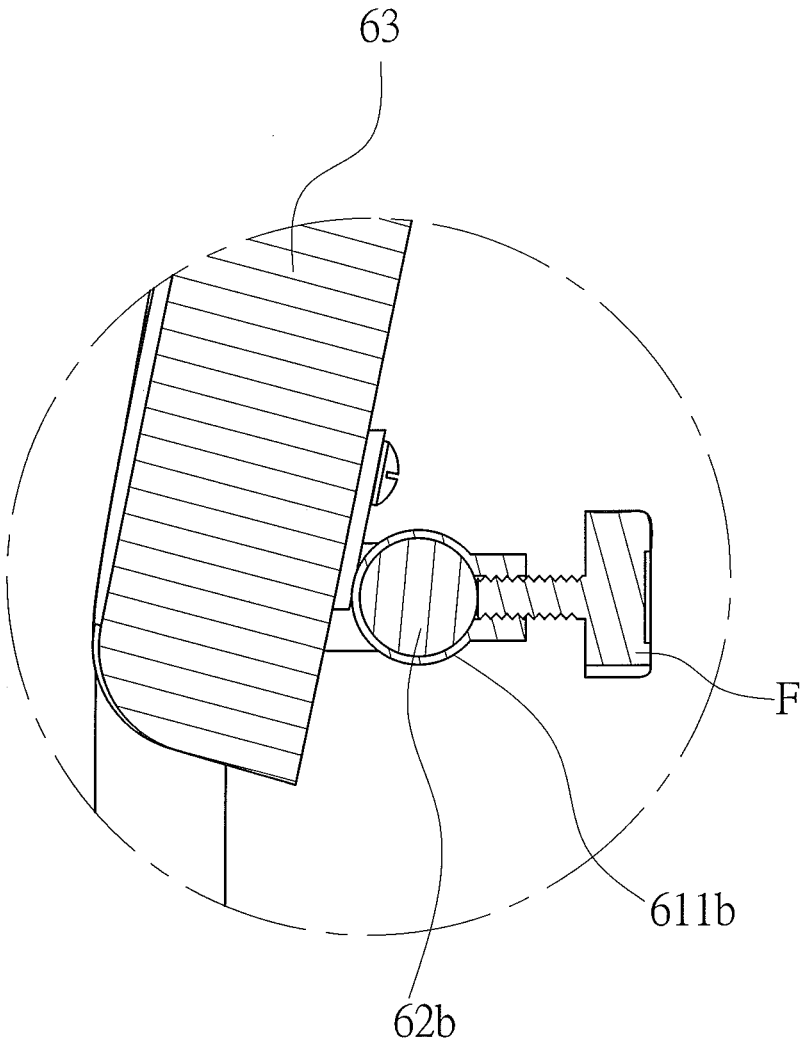
FIG. 10 is an enlarged, sectional diagram of a circled portion in FIG. 2, with the screwing element tightly locking the back connection tube of an embodiment of the invention.

The back unit 61 and the back connection tubes 62*a*~62*d* can be equipped with the telescopic function by a plurality of screwing elements F, especially by the combination of the plurality of screwing elements F and a plurality of marks M. In detail, the back unit 61 includes two parallel tubes 611*a*, 611*b* which are disposed on the back side of a cushion 63, wherein the tube 611*a* can contain and connect to the back connection tubes 62*a*, 62*c*, and the tube 611*b* can contain and connect to the back connection tubes 62*b*, 62*d*. The tube 611*b* is configured with a plurality of screwing elements F, for example two. When the back connection tubes 62*b*, 62*d* move within the tube 611*b*, the back connection tubes 62*b*, 62*d* can be locked by the screwing elements F so as to be fixed to the determined position, as shown in FIG. 10. Therefore, when the widths of the telescopic seat frame set 20, the telescopic front enhancement tube set 30 and the telescopic rear enhancement tube set 40 are adjusted to adjust the width of the wheelchair 1, the cushion can be disposed in the middle position again so as to hold the head or back of the user. In this embodiment, the marks M are disposed on the back connection tubes 62*a*~62*d*, and the screwing elements F are disposed on the back unit 61. Besides, a distance between the two adjacent holes H is substantially equal to a distance between the two adjacent marks M, whereby the user can adjust the width of the components in the most proper way.

In this embodiment, the supporting units 51, 52 are connected to a holding tube 53 to form a holding bar of the wheelchair 1. The holding tube 53 and the supporting units 51, 52 also can achieve the telescopic function by the combination of the pressing buttons B and the holes H. Herein for example, the pressing buttons B are disposed on the supporting units 51, 52 and the holes H are disposed on the holding tube 53. Since the connection manner for them is similar to the above embodiments, the related description is omitted here for conciseness.

Figure 7:
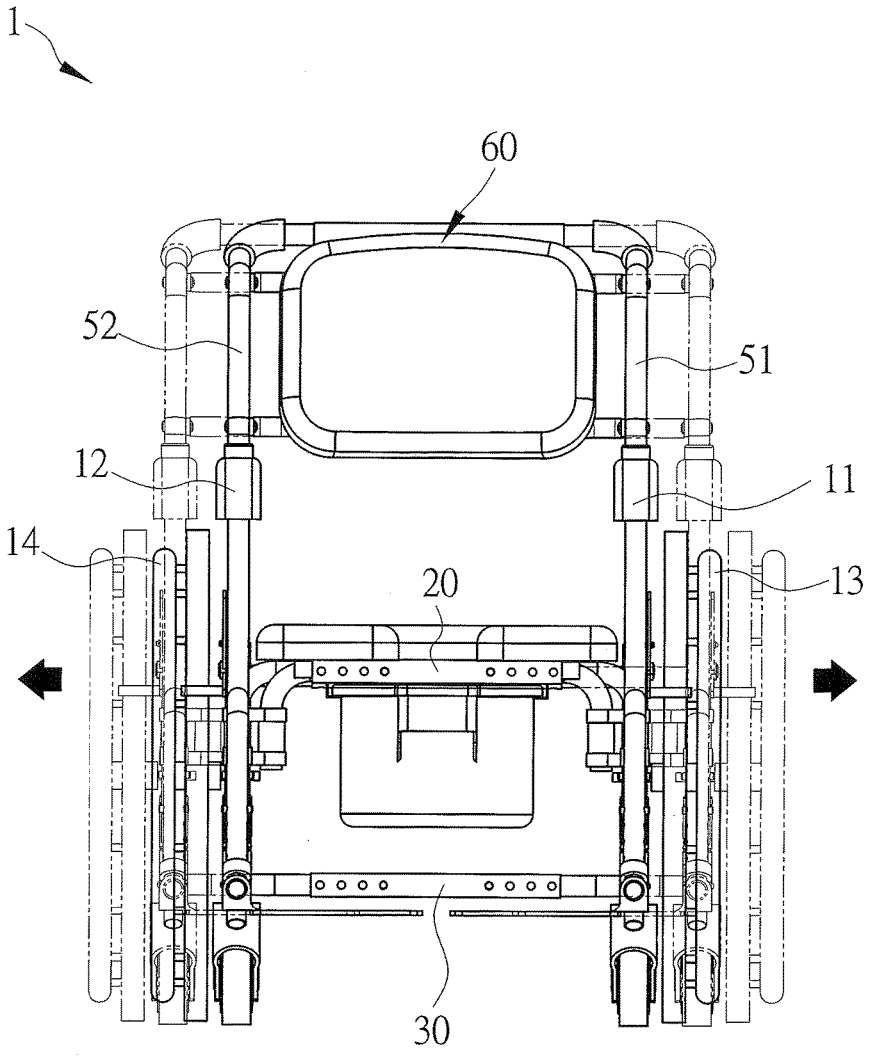
FIG. 7 is a schematic diagram of the wheelchair adjusted in width of an embodiment of the invention.

In this embodiment, the widths of the telescopic seat frame set 20, the telescopic front enhancement tube set 30, the telescopic rear enhancement tube set 40 and the telescopic back set 60 can be adjusted to adjust the width of the wheelchair 1, just as shown in FIG. 7.

Moreover, as shown in FIGS. 1~3, in this embodiment, the wheelchair 1 can further include a seat 101, which is disposed on the seat frame 21. The wheelchair 1 also can further include an excrement container 102, which is disposed below the seat frame 21. Moreover, the wheelchair 1 also can further include two pedals 103, 104, which are connected with the side frames 11, 12, respectively, to hold the user's foot. The connection manner for them also can be achieved by the combination of the pressing buttons and the holes to possess the telescopic function, and the height of the pedals 103, 104 can be controlled.

In summary, a wheelchair according to the invention includes the telescopic seat frame set, the telescopic front enhancement tube set, the telescopic rear enhancement tube set, and the telescopic back set. By the above configuration, the wheelchair of the invention can be easily adjusted in width according to the physical size of the user so that the all users can be given the fine comfort. Besides, the back unit and the back connection tubes can be given the telescopic function by a plurality of screwing elements. Thereby, when the wheelchair is adjusted in width, the back unit also can be adjusted to the middle position to hold the user's head or back.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

The invention claimed is:

1. A wheelchair comprising:

two side frames;

two wheels connected with the two side frames respectively;

a telescopic seat frame set including a seat frame and a plurality of seat connection tubes, wherein two ends of each of the seat connection tubes are connected with the seat frame and a corresponding one of the two side frames, respectively, wherein the seat frame and the seat connection tubes are made telescopic by a combination of pressing units and holes;

a telescopic front enhancement tube set including a front tube and a plurality of front connection tubes, wherein two ends of each of the front connection tubes are connected with the front tube and a corresponding one of the two side frames, respectively, wherein the front tube and the front connection tubes are made telescopic by a combination of pressing units and holes;

a telescopic rear enhancement tube set including a rear tube and a plurality of rear connection tubes, wherein two ends of each of the rear connection tubes are connected with the rear tube and a corresponding one of the two side frames, respectively, wherein the rear tube and the rear connection tubes are made telescopic by a combination of pressing units and holes;

two supporting units connected with the two side frames respectively; and a telescopic back set including a back unit and a plurality of back connection tubes, wherein each of the back connection tubes are connected with the back unit and a corresponding one of the two supporting units, respectively, wherein the back unit and the back connection tubes are made telescopic by a plurality of screwing elements.

2. The wheelchair as recited in claim 1, wherein each of the seat connection tubes includes a bent portion and is connected with the corresponding side frame through the bent portion.

3. The wheelchair as recited in claim 1, wherein one end of each of the seat connection tubes connected with the side frame is connected with the side frame by a pressing unit.

4. The wheelchair as recited in claim 1, wherein each of the front connection tubes includes a bent portion and is connected with the corresponding side frame through the bent portion.

5. The wheelchair as recited in claim 1, wherein one end of each of the front connection tubes connected with the side frame is connected with the side frame by a pressing unit.

6. The wheelchair as recited in claim 1, wherein the two supporting units are connected with a holding tube to form a holding bar of the wheelchair, and the holding tube and the two supporting units are made telescopic by a combination of a plurality of pressing units and a plurality of holes.

7. The wheelchair as recited in claim 1, wherein the back unit and the back connection tubes are made telescopic by a combination of the screwing elements and a plurality of marks, the marks are disposed on the back connection tubes, and the screwing elements are disposed on the back unit.

8. The wheelchair as recited in claim 6, wherein the back unit and the back connection tubes are made telescopic by a combination of the screwing elements and a plurality of marks, and a distance between the two adjacent holes is substantially equal to a distance between the two adjacent marks.

9. The wheelchair as recited in claim 1, further comprising:

a seat disposed on the seat frame.

10. The wheelchair as recited in claim 1, wherein the pressing unit includes a pressing button and a spring element connected with the pressing button.

* * * * *